US010125535B2

(12) United States Patent
Máder

(10) Patent No.: US 10,125,535 B2
(45) Date of Patent: Nov. 13, 2018

(54) SPACER FOR SPACING GLASS PANES IN A MULTIPLE GLASS PANE, A MULTIPLE GLASS PANE, AND A METHOD FOR PRODUCING A MULTIPLE GLASS PANE

(75) Inventor: Hans Rudolf Máder, Morschwil (CH)

(73) Assignee: Lisec Austria GMBH, Seitenstetten (AT)

( * ) Notice: Subject to any disclaimer, the term of this patent is extended or adjusted under 35 U.S.C. 154(b) by 1121 days.

(21) Appl. No.: 13/263,276

(22) PCT Filed: Apr. 7, 2009

(86) PCT No.: PCT/EP2009/054153

§ 371 (c)(1),
(2), (4) Date: Dec. 16, 2011

(87) PCT Pub. No.: WO2010/115456

PCT Pub. Date: Oct. 14, 2010

(65) Prior Publication Data

US 2012/0141699 A1 Jun. 7, 2012

(51) Int. Cl.
*E06B 3/663* (2006.01)

(52) U.S. Cl.
CPC ..... *E06B 3/66366* (2013.01); *Y10T 29/49826* (2015.01)

(58) Field of Classification Search
CPC ..... E06B 3/663; E06B 3/66366
USPC ..... 156/99, 109
See application file for complete search history.

(56) References Cited

U.S. PATENT DOCUMENTS

| | | | | |
|---|---|---|---|---|
| 3,293,065 | A * | 12/1966 | Roetter | C03C 27/046 427/224 |
| 4,615,431 | A * | 10/1986 | Lisec | B65G 47/52 198/468.6 |
| 6,266,940 | B1 | 7/2001 | Reichart | |
| 6,280,826 | B1 * | 8/2001 | Woll | B32B 17/10045 109/49.5 |
| 2003/0074859 | A1 | 4/2003 | Rechert et al. | |
| 2005/0028460 | A1 * | 2/2005 | Steffek | E06B 3/24 52/204.5 |
| 2005/0107243 | A1 * | 5/2005 | Kilthau et al. | 502/60 |
| 2007/0175733 | A1 * | 8/2007 | Lenhardt | E06B 3/67386 198/468.6 |
| 2012/0094040 | A1 * | 4/2012 | Mader | E06B 3/66361 156/109 |

FOREIGN PATENT DOCUMENTS

| | | |
|---|---|---|
| DE | 19816735 | 10/1999 |
| GB | 2198776 A | 6/1988 |
| JP | 4997810 | 2/1976 |
| WO | 98/19036 A1 | 5/1998 |
| WO | 2008022877 A1 | 2/2008 |

* cited by examiner

*Primary Examiner* — Philip C Tucker
*Assistant Examiner* — John Blades
(74) *Attorney, Agent, or Firm* — Davis & Bujold PLLC; Michael J. Bujold

(57) ABSTRACT

The invention relates to a multiple glass pane (6) comprising two outer glass panes (4, 4'), at least one center glass pane (5), and a spacer (1), wherein the spacer (1) comprises a hollow space (2, 2') for receiving a desiccant (3) and a receiving profile (7) for each center glass pane (5), and the hollow space (2, 2') of the spacer (1) is filled with a desiccant (3).

12 Claims, 3 Drawing Sheets

Figure 1:
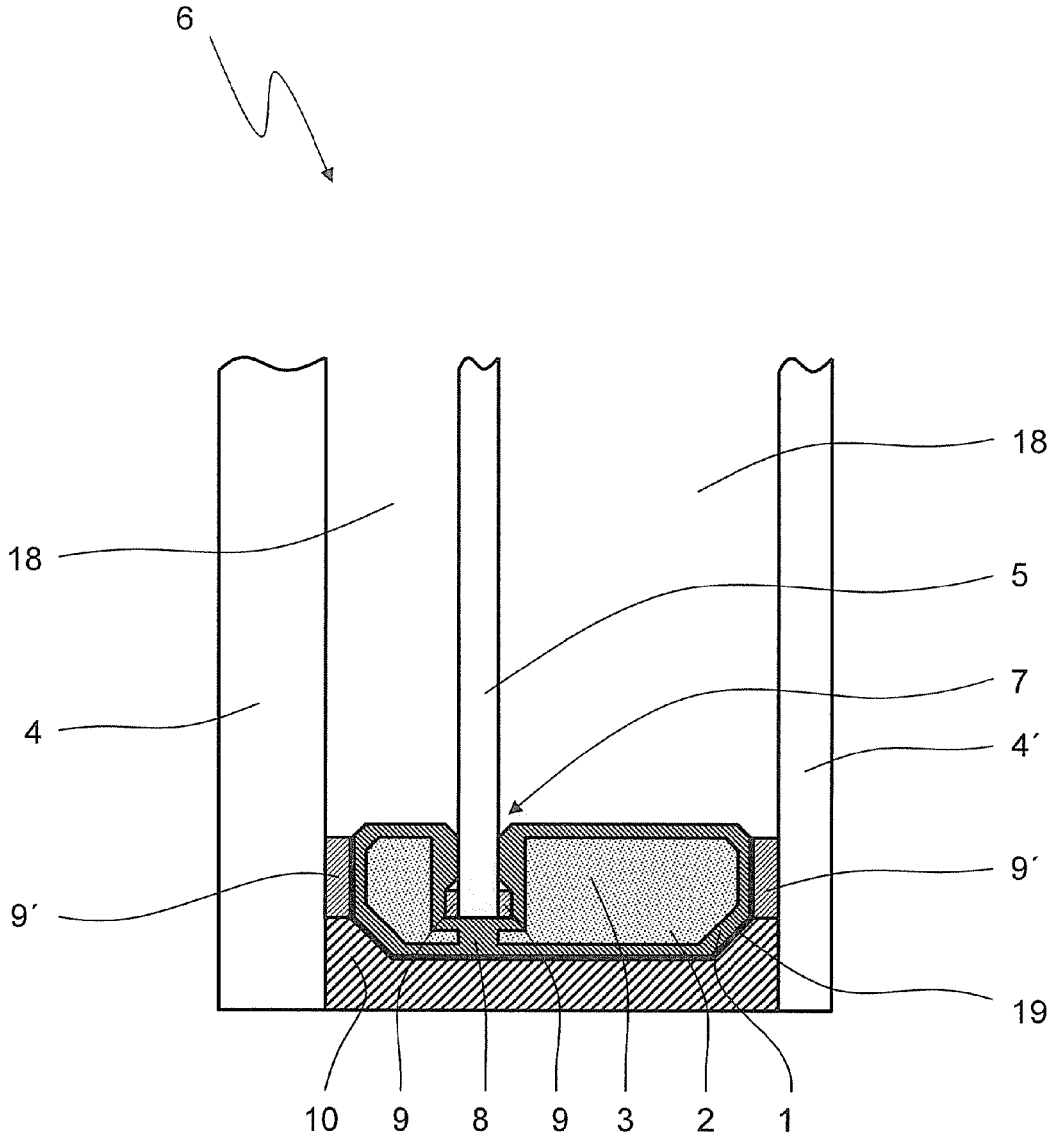

SPACER FOR SPACING GLASS PANES IN A MULTIPLE GLASS PANE, A MULTIPLE GLASS PANE, AND A METHOD FOR PRODUCING A MULTIPLE GLASS PANE

The invention relates to a spacer for spacing glass panes in a multiple glass pane, to a multiple glass pane and to a method for producing a multiple glass pane with the features of the preambles of the independent claims.

Conventional insulating glazing units have until now been produced predominantly by the double glazing technique. Various spacers and various methods for producing the insulating glazing are known for the structural design and production of such units.

For example, WO 2008/022877 A1 shows a method for producing an insulating glass pane, the spacer being flexible and being provided with a desiccant immediately before or during the fitting of the spacer on the one glass pane. This method comprises the sequential steps of first providing a glass pane, then applying the spacer to this glass pane and subsequently fastening a second glass pane on the spacer fitted on the first glass plane. If it is intended to produce a multiple glass pane by this method, a spacer is in turn applied to the previously produced glass pane assembly and a further glass pane is subsequently fitted onto the spacer. Particular disadvantages of such a method are that, in the case of multiple glazing, the spacers each have to be aligned precisely with one another and that the fitting steps are laborious and time-consuming.

In WO 98/19036 A1, a method and a spacer for glazing multiple insulating glass panes are shown. The spacer is produced from a polymer material. The spacer has approximately in the middle a recess for receiving a center glass pane. The two outer glass panes are fixed at the edges to the spacer by double-sided adhesive tape. With an additional primary seal, the intermediate space between the individual glass panes is closed in a gas-tight manner. A desiccant is applied to the spacer between the individual glass panes.

US 2003/0074859 A1 shows a spacer comprising an inner element and an outer element, the inner element being of a U-shaped form and serving in particular for stabilizing the spacer. The outer element is applied around the inner element. A desiccant is an integrated part of the outer element. When the upper ends of the U-shaped profile of the inner element are pulled further inward, a center glass plane can be fixed therein.

The known spacers for multiple glazing units, in particular for those with more than two glass panes, have the disadvantage that the desiccant has to be applied to the spacer in a complicated manner. Furthermore, the external application of the desiccant restricts the choice of desiccant.

It is therefore an object of the present invention to avoid the disadvantages of the known art, in particular to provide a spacer, a multiple glass pane and a method for producing a multiple glass pane of the type mentioned at the beginning that make it possible for such multiple glass panes to be produced in a simple way. In particular, it is intended to ensure that a desiccant with a high and long-lasting adsorption capacity can be used.

These objects are achieved according to the invention by a spacer, a multiple glass pane and a method for producing a multiple glass pane with the features according to the invention.

A spacer for spacing glass panes in a multiple glass pane which comprises two outer glass panes around at least one center glass pane has a receiving profile for each center glass pane. The spacer extends laterally outward from the receiving profile on both sides, so that the outer glass panes can be put in place. Furthermore, the spacer has at least one hollow space for receiving a desiccant. The receiving profile is preferably of a groove-shaped form and is located on the inner side of the spacer when the latter is fitted in a multiple glass pane. For receiving the desiccant, the spacer has one or more hollow spaces, which preferably correspond to a hollow space profile extending in the longitudinal direction. In this respect, it is conceivable for the hollow spaces to be connected to one another. A hollow space is understood here and hereafter as meaning a space that is enclosed on all sides by the spacer. Although such a hollow space is enclosed, there is a gas connection between the hollow space and an intermediate space between two adjacent glass panes. Such a gas connection may take place through the material of the spacer or be made possible by means of a perforation or other extremely small openings in the wall of the hollow space.

The fact that the spacer encloses at least one hollow space means that its thermal conductivity is significantly reduced, which has the effect of an improved insulating capability of the multiple glass pane. Furthermore the desiccant can be securely enclosed, allowing the use of a desiccant that is for example in the form of a powder or granules. Such a desiccant has a much larger active surface area than, for example, a desiccant in a solid or pasty form.

The spacer preferably consists of a flexible material, so that it can be adapted in a way corresponding to the contour of the glass. For example, the spacer is produced from silicone or a similar flexible, UV-resistant and non-fogging material. Foamed plastics may also be used with preference for the spacer. The material of the spacer consists in particular of silicone, polypropylene (PP), polycarbonate (PC), polyvinylchloride (PVC) or ethylene-propylene-diene rubber (EPDM). At the same time, the material is preferably flexible. Rigid materials, such as for example high-grade steel, aluminum or other materials, can likewise be used. In the case of plastics materials, the spacer may have on its outer side an additional vapor barrier, in particular in the form of a metallic rolled sheet and/or a sputtered/vapor-deposited metallic or vitreous layer.

The spacer is preferably formed in one piece. This facilitates the entire handling during the fitting of the multiple glass pane. Furthermore, particularly low-cost production is made possible by the one-piece form of the spacer.

Particularly advantageously, the spacer has for each pair of adjacent glass panes a respective hollow space for receiving the desiccant. A pair of adjacent glass panes is typically understood as meaning the center glass pane and one of the outer glass panes. In the case of multiple glazing units, such a pair may also be formed by two adjacent center glass panes. As long as each hollow space is provided with a desiccant, this has the effect that moisture is optimally removed from each intermediate space between two adjacent glass panes.

The hollow spaces and the at least one center glass pane may be arranged asymmetrically between the outer glass panes. This asymmetric arrangement particularly achieves improved sound damping. It goes without saying that symmetrical arrangements are also possible.

Furthermore, the hollow spaces of the spacer may be connected to one another. This allows an exchange of the desiccant from one hollow space to the other to take place, in particular during the filling of the hollow spaces with desiccant. This also prevents a difference in pressure between the intermediate spaces between adjacent glass panes.

The receiving profile for each center glass pane may have a support with respect to the side of the spacer that is opposite from the receiving profile. This support has the effect in particular in the case of large glass panes that the center glass pane is supported by its entire underside, and can consequently be fitted as free from stress as possible. Such a support preferably has apertures through which the hollow spaces are connected to one another.

A further aspect of the invention concerns a multiple glass pane comprising two outer glass panes, at least one center glass pane and a spacer according to the description given above, in the receiving profile of which the center glass plane is inserted. The hollow space of the spacer is in this case filled with a desiccant. The fact that the desiccant is enclosed in a hollow space of the spacer means that any desired desiccant can be used. There are no restrictions with respect to consistency of the desiccant. In particular, a free-flowing desiccant may also be used.

With preference, the center glass pane of the multiple glass pane is fixed in the receiving profile directly by a primary seal. For this purpose, the receiving profile may have a special recess, in which the primary seal comes to lie. Such a recess may, for example, take the form of an undercut. By fixing the center glass pane by the primary seal, an exchange of air between the various intermediate spaces of the multiple glass pane is prevented, or is only possible through the hollow spaces that are filled with desiccant and the connections thereof. It is also possible to dispense with the use of an additional adhesive for fixing the center glass pane. For the primary seal, butyl-, acrylate- or hotmelt-based adhesives may be used in particular.

A further aspect of the invention concerns a method for producing a multiple glass pane with two outer glass panes and at least one center glass pane. The method substantially comprises the following steps:

a) providing the at least one center glass pane and a spacer,
b) introducing a desiccant into or onto the spacer,
c) bordering each center glass pane with the spacer, so that each center glass pane is received at its periphery by a receiving profile of the spacer,
d) providing two outer glass panes and
e) placing the two outer glass panes onto the spacer.

With preference, the provision of the outer glass panes takes place at the same time as the bordering of the at least one center glass pane. This allows a fitting installation to be used optimally and waiting times to be avoided as far as possible. Washing of the outer glass panes simultaneously with the bordering of the center glass pane is particularly advantageous, since the washing is relatively time-consuming.

In a particularly preferred method, the introduction of the desiccant into or onto the spacer takes place immediately before or at the same time as the bordering of the center glass panes. It can thereby be ensured that the desiccant is as fresh as possible and has a high capacity for absorbing moisture.

The desiccant may be filled into at least one hollow space of the spacer. The filling of the desiccant into a hollow space of the spacer makes it possible to use desiccant of varying consistency. However, the desiccant is advantageously free-flowing. If the hollow spaces of the spacer are connected to one another, filling may take place through an opening in a single hollow space, and the further hollow spaces are likewise packed with desiccant. The filling is consequently particularly easy.

In a preferred way, as it is being introduced into or onto the spacer, the desiccant is monitored by means of an analyzing device for measuring the degree of activity of the desiccant. When measuring the degree of activity of the desiccant, the absorption capacity may be measured in particular. By this measurement it can be ensured that spent desiccant or desiccant with a poor absorption capacity is not used. The measurement may take place in batches or else be carried out continuously.

As each center glass pane is being bordered, it may be fixed in the receiving profile of the spacer with the aid of a primary seal.

Figure 2:
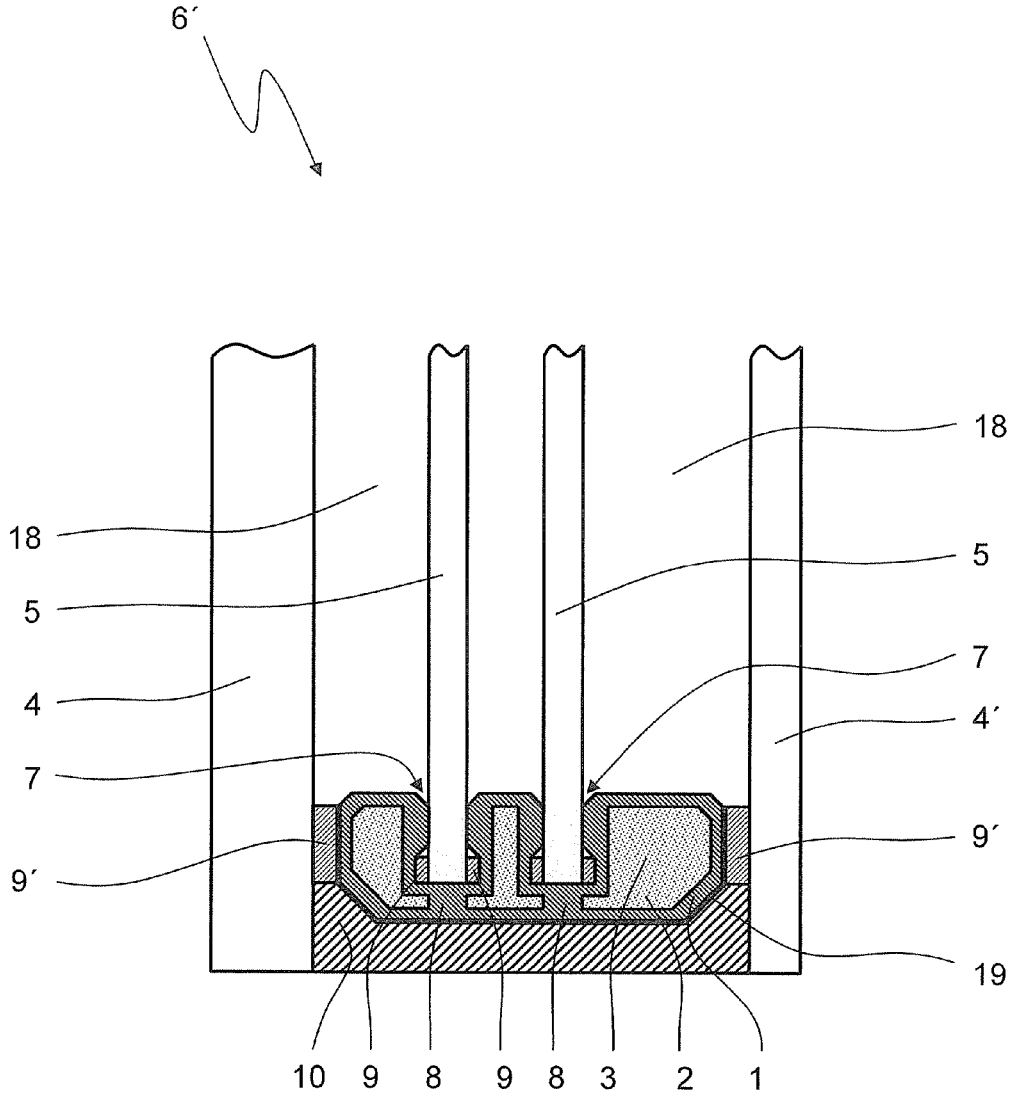
Figure 3:
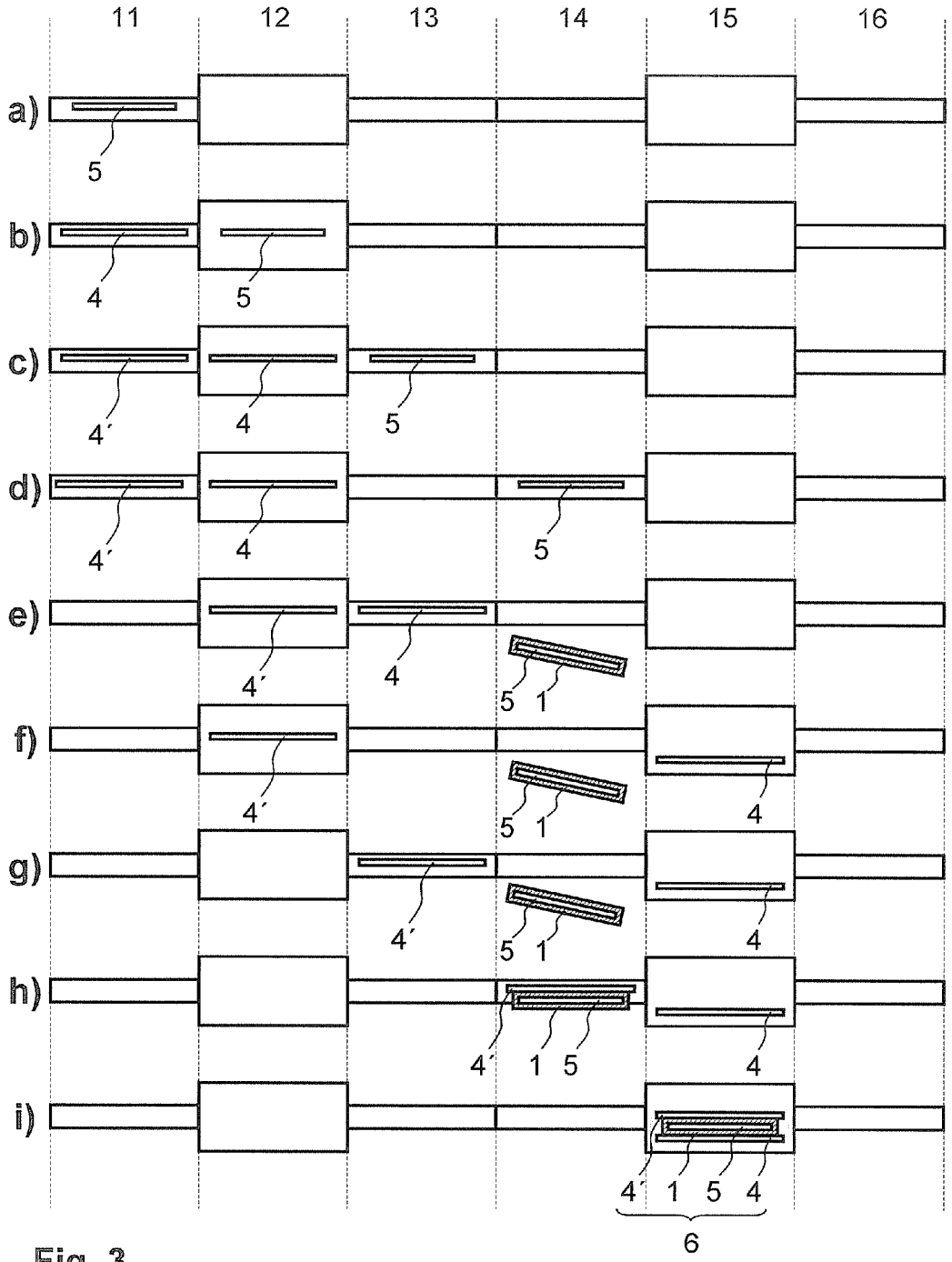

Further details and advantages of the invention emerge from the following description of exemplary embodiments and from the drawings, in which:

FIG. 1 shows a peripheral cross section through a triple glazing unit according to the invention, FIG. 2 shows a peripheral cross section through an insulating glazing unit according to the invention with four glass panes, and FIGS. 3*a*) to *i*) show a schematic representation of a time sequence of the process for producing a multiple glazing unit.

FIG. 1 shows a peripheral cross section through a multiple glass pane 6 with three glass panes 4, 4' and 5. The center glass pane 5 is peripherally enclosed by a spacer 1. The spacer 1 has a receiving profile 7 in the form of a groove for receiving the center glass pane 5. The receiving profile 7 is at the same time dimensioned such that, apart from the center glass pane 5, it also receives a primary seal 9. The primary seal 9 is arranged on both sides of the center glass pane 5 and serves for fixing the center glass pane in spacer 1. The receiving profile 7 has an undercut, which receives the primary seal 9 on both sides of the center glass pane 5.

Arranged parallel to the center glass pane 5 on both sides of the spacer 1 are the outer glass panes 4 and 4'. The outer glass panes 4 and 4' are fastened to the spacer by means of a primary seal 9'. The primary seals 9 and 9' each take the form of a butyl edge. Alternatively, primary seals of acrylate or hotmelt may also be used. The spacer 1 has on both sides of the receiving profile 7 for the center glass pane 5 a respective hollow space 2, 2'. This hollow space 2, 2' is respectively filled with a desiccant 3. The receiving profile 7 is connected by a support 8 to the periphery of the spacer 1 opposite from the intermediate spaces 18 between the glass panes 4, 4' and 5. This support 8 may be both solid and provided with through-cuts, so that the two hollow spaces 2, 2' are connected to one another. Flush with the end face of the two outer glass panes 4 and 4' there is a secondary seal 10 of polysulfide, polyurethane, hotmelt and/or silicone.

Together with the spacer 1, the primary seals 9' form a water vapor barrier and seal the intermediate spaces 18 in a vapor-proof manner. The primary seals 9 on both sides of the center glass pane 5 have the effect that an exchange of gas between the two intermediate spaces 18 is prevented, or can only take place through the hollow spaces 2, 2' filled with desiccant 3 and the connections thereof.

The spacer 1 preferably consists of silicone, polypropylene (PP), polycarbonate (PC), polyvinylchloride (PVC) or ethylene-propylene-diene rubber (EPDM). At the same time, the material is preferably flexible. Rigid materials, such as for example high-grade steel, aluminum or other materials, can likewise be used. In the case of plastics materials, the spacer 1 may have at least on its outer side an additional vapor barrier 19, in particular in the form of a metallic rolled sheet and/or a sputtered/vapor-deposited metallic or vitreous layer.

FIG. 2 shows a peripheral cross section through a multiple glass pane 6' with two outer glass panes 4 and 4' and two center glass panes 5. The quadruple glass pane 6' only differs insignificantly in its structure from the triple glass pane 6 from FIG. 1. The center glass panes 5 are received at their periphery by two receiving profiles 7 of the spacer 1. At the same time, both receiving profiles 7 are each connected by way of a support 8 to the periphery of the spacer 1 that is opposite from the intermediate spaces 18. Arranged on each of both sides of the spacer 1 is an outer glass pane 4 and 4'. The spacer 1 has for each intermediate space 18 between two adjacent glass panes 4, 4' and 5 a respective hollow space 2, 2', 2". Each of these hollow spaces is filled with a desiccant 3. Although the hollow spaces 2, 2', 2" are closed, an exchange of gas takes place between the intermediate spaces 18 and the hollow spaces 2, 2', 2". Consequently, moisture from the intermediate spaces 18 can be absorbed by the desiccant 3. The center glass panes 5 are provided on both sides at their periphery with a primary seal 9, and are thereby fixed in the receiving profile 7. For this purpose, the receiving profile 7 has an undercut. The two outer glass panes 4 and 4' are fastened to the spacer 1 by means of a primary seal 9'. Flush with the lower edge of the outer glass panes 4 and 4', a secondary seal 10 is provided between the two outer glass panes 4 and 4'. This secondary seal serves in particular for mechanically stabilizing the multiple glass pane 6'. The spacer 1 is provided on its outer side, i.e, on the side facing the secondary seal 10, with an additional vapor barrier 19.

In FIGS. 3*a*) to *i*), a schematic representation of a time sequence for producing a multiple glass pane 6 on a production line is shown. In step a), a center glass pane 5 is in a pane feed 11 of the production line. In step b), the center glass pane 5 is in the washing station 12, while an outer glass pane 4 is in the pane feed 11. The washing of the glass panes is a time-consuming process and normally takes longer than the other steps. In step c), the center glass pane 5 is in what is known as an inspection station 13, where it is checked for defects or impurities. Correspondingly, the outer glass pane 4 is in the washing station 12 and a second outer glass pane 4' is in the pane feed 11. Step d) shows the center glass pane 5 in a bordering station 14. The first outer glass pane 4 is still in the washing station 12 and the second outer glass pane 4' is in the pane feed 11. Step e) shows the center glass pane 5 in the bordering station 14, where it is being enclosed by the spacer 1. The bordering station 14 is in this case pivoted out from the production line, which allows the spacer 1 to be fed in more easily. Similarly, as a result the production line is not blocked and a following glass pane can be transported past the bordering station 14 into the next station. Instead of pivoting out, a parallel displacement of the bordering station 14 out of the production line may also take place. The first outer glass pane 4 is checked for defects in the inspection station 13, while the second outer glass pane 4' is being washed. In step f), the first outer glass pane 4 is already in an assembly station 15 and has skipped the bordering station 14, and consequently also the center glass pane 5. The center glass pane 5 is still being bordered by the spacer 1 in the bordering station 14, while the second glass pane 4 is still in the washing station 12. In step g), the second outer glass pane 4' is in the inspection station 13 and is being checked for defects. In step h), the second outer glass pane 4' is in the bordering station 14, which has been pivoted back into the production line, and is being connected to the spacer 1 of the center glass pane 5. Subsequently, in step i), the center glass pane 5 is transported along with the spacer 1 and the second outer glass pane 4' into the assembly station 15, where the second side of the spacer 1 is connected to the first outer glass pane 4. Here the pressing of the glass panes also takes place, and possibly filling with a gas. In a following working step, the multiple glass pane 6 is processed still further in a sealing station 16. This step is not represented in any more detail.

Alternatively, in step h), the second outer glass pane 4' may already be transported into the assembly station 15 and the bordering station 14 with the center glass pane 5 and the spacer 1 pivoted back into the production line. Consequently, then in step i), the spacer 1 is transported along with the center glass pane 5 into the assembly station 15 between the two outer glass panes 4 and 4' and connected to them, pressed and optionally filled with gas. The steps which follow are then again identical.

A step-by-step assembly in the assembly station 15 is likewise conceivable. In this case, for example, first the first outer glass pane 4, then the spacer 1 along with the center glass pane 5 and finally the second outer glass pane 4' are transported into the assembly station 15 and connected to one another.

The invention claimed is:

1. A method for producing a multiple glass pane with two outer glass panes and at least one center glass pane, the method comprising:

providing the at least one center glass pane and a spacer, wherein said spacer is formed in a continuous one piece manner of an integral material, the spacer defines one receiving profile for each of the at least one center glass pane, and the spacer has two opposed outwardly facing flat lateral surfaces, displacing the at least one center glass pane, with respect to a production line, to a bordering station such that an outer glass pane is transported along the production line past the displaced at least one center glass pane to an assembly area, bordering each of the at least one center glass pane with said spacer, while being displaced from the production line, so that each of the at least one center glass pane is received and enclosed, about its periphery, by said receiving profile of said spacer, conveying the bordered at least one center glass pane to the assembly area, providing a second outer glass pane to the assembly area, and placing and connecting each of the two outer glass panes against a respective one of the two opposed outwardly facing flat lateral surfaces of said spacer such that the outer glass panes form a seal with the spacer and are parallel to each other and to the at least one center glass pane, wherein providing outer glass panes takes place during the bordering of the at least one center glass pane.

2. The method as claimed in claim 1, characterized in that a desiccant is introduced into or onto the spacer immediately before, or at the same time as, the bordering of the at least one center glass pane.

3. The method as claimed in claim 2, characterized in that the desiccant is filled into at least one hollow space of the spacer.

4. The method as claimed in claim 2, characterized in that, as the desiccant is being introduced into or onto the spacer, the desiccant is monitored by an analyzing device for measuring the degree of activity of the desiccant.

5. The method as claimed in claim 1, characterized in that, as each center glass pane is being bordered, the center glass pane is fixed in the receiving profile of the spacer with the aid of a primary seal.

6. The method as claimed in claim 2, characterized in that, as the desiccant is being introduced into or onto the spacer, the desiccant is monitored by an analyzing device for measuring an adsorption capacity of the desiccant.

7. The method as claimed in claim 1, wherein providing of a glass pane comprises the step of washing and inspecting the glass pane for impurities and defects.

8. A method for producing a multiple glass pane with two outer glass panes and at least one center glass pane, the method comprising steps of:

providing a one continuous piece spacer of integral material having a cross section profile that has two opposed outwardly facing flat lateral surfaces and at least one receiving profile for receiving a respective one of the at least one center glass pane, the at least one receiving profile being arranged in the spacer laterally between the two opposed outwardly facing flat laterally surfaces of the continuous piece spacer, displacing the at least one center glass pane, with respect to a production line, to a bordering station such that outer glass panes are transported along the production line past the displaced at least one center glass pane to an assembly area, bordering each of the at least one center glass pane, while being displaced from the production line, with the spacer such that an outer periphery each of the at least one center glass pane is received and enclosed within the respective at least one receiving profile of the spacer, providing the two outer glass panes to the assembly area during the step of bordering each of the at least one center glass pane with the spacer, subsequently connecting the two outer glass panes, at the assembly area, to a respective one of the two opposed outwardly facing flat lateral surfaces, such that the two outer glass panes form a seal with the spacer and are parallel to each other and to the at least one center glass pane.

9. A method for producing a multiple glass pane with two outer glass panes and at least one center glass pane, and the center glass pane has a spacer, the spacer is formed in a continuous one piece manner of an integral material, the spacer defines one receiving profile for each of the at least one center glass pane, and the spacer has two opposed outwardly facing flat lateral surfaces, the method comprising:

1) feeding the at least one center glass pane along a production line,
2) displacing the at least one center glass pane with respect to the production line,
3) transporting at least one subsequent glass pane, which will form a first one of the two outer panes, along the production line past the displaced at least one center glass pane to an assembly station,
4) bordering the displaced at least one center glass pane with a spacer, while that at least one center glass pane is displaced from the production line, so that the at least one center glass pane is received and enclosed, about its periphery, within the receiving profile of the spacer,
5) after the displaced at least one center glass pane is bordered with the spacer, transporting the at least one center glass pane, bordered with the spacer, along the production line to the assembly station,
6) transporting a second one of the two outer glass panes along the production line to the assembly station, and
7) assembling the first and the second two outer glass panes against a respective one of the two opposed outwardly facing flat lateral surfaces of the spacer, at the assembly station, such that the first and second outer glass panes form a seal with the spacer and are parallel to each other and to the at least one center glass pane.

10. The method as claimed in claim 9, further comprising transporting the second one of the two outer glass panes to the assembly station before the at least one center glass pane, bordered with the spacer, is transported to the assembly station.

11. The method as claimed in claim 9, further assembling the second one of the two outer glass panes with the at least one center glass pane, bordered with the spacer, prior to reaching the assembly station.

12. The method as claimed in claim 9, further comprising repeating steps 1-7 to produce additional multiple glass panes with two outer glass panes.

* * * * *